United States Patent [19]

Lienenlüke et al.

[11] 4,146,283

[45] Mar. 27, 1979

[54] VACUUM CLEANER HEAD

[75] Inventors: Paul Lienenlüke, Sprockhövel; Wieland Gühne, Remscheid; Georg Haase, Radevormwald, all of Fed. Rep. of Germany

[73] Assignee: Vorwerk & Co Interholding GmbH, Wuppertal, Fed. Rep. of Germany

[21] Appl. No.: 830,866

[22] Filed: Sep. 6, 1977 (Under 37 CFR 1.47)

[30] Foreign Application Priority Data

Sep. 10, 1976 [DE] Fed. Rep. of Germany ..... 7628311

[51] Int. Cl.[2] ..... H01R 3/04

[52] U.S. Cl. ..... 339/15; 339/16 R

[58] Field of Search ..... 339/15, 16 R

[56] References Cited

U.S. PATENT DOCUMENTS

| | | | |
|---|---|---|---|
| 3,387,319 | 6/1968 | Ferraris et al. | 339/16 R X |
| 4,018,493 | 4/1977 | Lyman et al. | 339/15 |

*Primary Examiner*—Roy Lake
*Assistant Examiner*—DeWalden W. Jones
*Attorney, Agent, or Firm*—Michael J. Striker

[57] ABSTRACT

A separate power head for a vacuum cleaner is detachably connectable with the vacuum cleaner housing. It has a casing provided with an airflow passage and an electric motor. A tubular connector serves to connect the head to the housing and to simultaneously establish an airflow connection between the airflow passage and a dust receptacle in the housing, as well as an electrical connection between the electric motor and a current supply source in the housing.

6 Claims, 2 Drawing Figures

FIG. 1
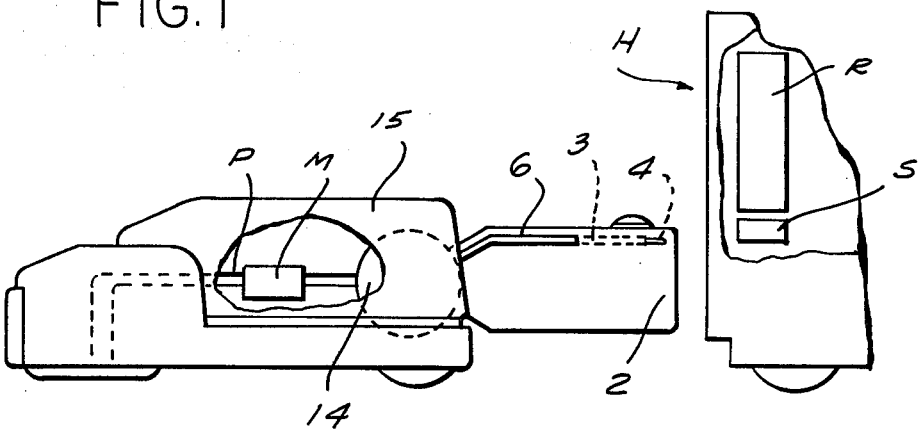
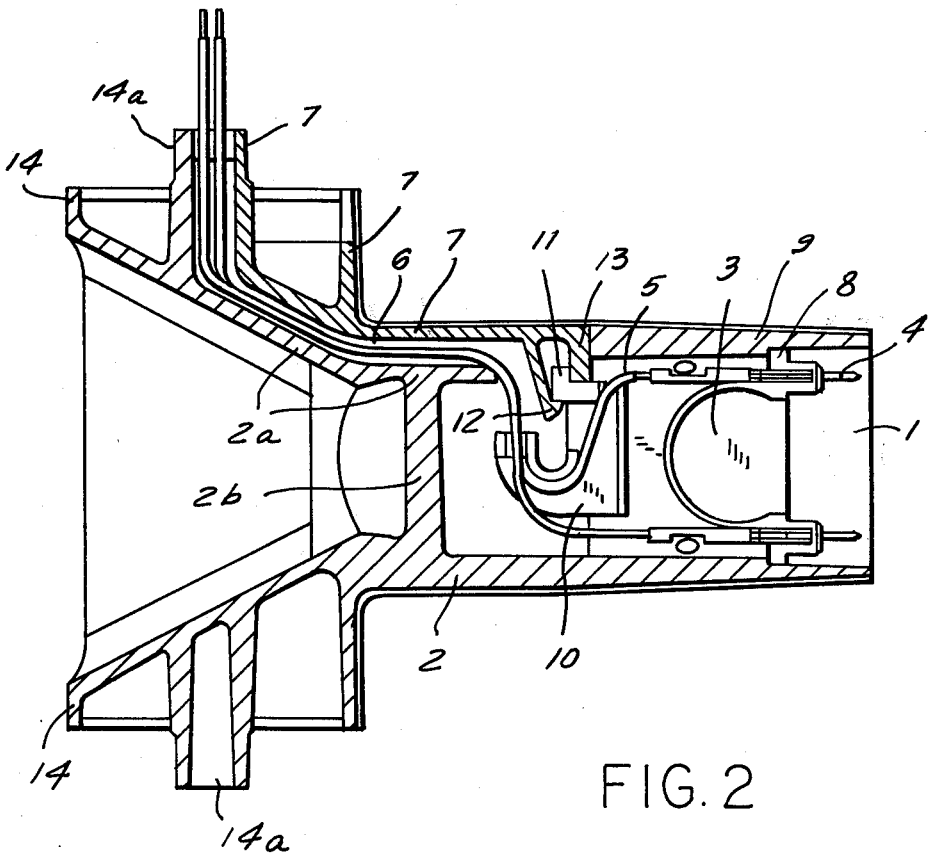
FIG. 2

VACUUM CLEANER HEAD

BACKGROUND OF THE INVENTION

1. Field of the Invention

The present invention relates to vacuum cleaners.

More particularly, it relates to the type of vacuum cleaners having a separate power head which is detachably connectable with the vacuum cleaner housing.

2. The Prior Art

It is known to have vacuum cleaners whose housing contains a dust receptacle and a source of electrical energy, but wherein the actual suction effect is produced by an electric motor which is accommodated in a separate power head that is detachably connectable with the housing (and which usually also is provided with rotary brushes and/or carpet-beating elements). Of course, the housing itself also has a suction-producing motor which, however, operates only when the vacuum cleaner is without the power head.

When the power head is connected with the housing, two types of connections must be made, namely, one connection between the dirt intake passage of the power head and the dust receptacle of the housing, and another connection between the electric motor of the power head and a source of electrical energy in the housing. According to the prior art this is accomplished by using a tubular connector having an air channel that communicates the power head intake channel with the dust receptacle, and having additional channels which are separate from the air channel and which accommodate electrical conductors for supplying energy to the power-head motor. These additional channels are provided with a removable cover and lead to a terminal box in which a supply cable is connected with the electrical conductors in the channels. The terminal box is closed by a screw-down cover.

With this arrangement conductors can be led to the electric motor of the power head through a hollow pivot shaft by means of which the tubular connector is mounted in the casing of the power head. However, the aforementioned power cable must be permanently secured to the terminal box and then provided with a plug which is insertable in a net-current receptacle provided on the housing of the vacuum cleaner.

In other words: whenever the power head is connected to the vacuum cleaner housing two connections must be made: one for the airflow and one for the current supply. This is time-consuming and requires manual dexterity so that the operation is frequently found onerous by a user. Also, the initial installation of the electrical conductors in the connector is relatively complicated (they must be carefully inserted into their channels) and labor-intensive, thus making the assembly more difficult and the selling cost of the finished product correspondingly higher.

SUMMARY OF THE INVENTION

It is an object of the invention to overcome the prior-art disadvantages.

More particularly, it is an object of the invention to provide, in a vacuum cleaner of the type in question, an improved connector which establishes an airflow connection as well as the electrical connection between the power head and the vacuum cleaner housing, in automatic response to the engagement of the connector with the housing.

Another object is to provide such a connector which can be assembled quickly and simply from pre-assembled constituent components.

In keeping with these objects and with others which will become apparent hereafter, one feature of the invention resides, in a vacuum cleaner of the type having a housing provided with a dust receptacle and a source of electric energy, and a separate vacuuming head detachably connectable to the housing and provided with a casing having an airflow passage and an electric motor, a combination which comprises a tubular connector on the casing and detachably engageable with the housing; and means in the connector for communicating the airflow passage with the receptacle and the electric motor with the source in automatic response to engagement of the connector with the vacuum cleaner housing.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWING

FIG. 1 is a diagrammatic side view showing a vacuum cleaner provided with a connector according to the invention; and FIG. 2 is a longitudinal section through the connector shown in FIG. 1 and embodying the invention.

DESCRIPTION OF A PREFERRED EMBODIMENT

A vacuum cleaner housing H is fragmentarily shown in FIG. 1. In its interior it is provided with a dust receptacle R and a source of electric energy S, both shown in phantom lines. The airflow passages to the receptacle R are not shown. It is emphasized that the location of R and S' is symbolically shown and in actual fact need not correspond to the illustration. The source S is to be understood as an internal electrical socket which receives its electrical energy from the exterior in the usual manner, well known per se. The vacuuming components in the housing H are not shown; they correspond to the usual arrangement that is known per se.

When it is desired to obtain extra suction and/or when a floor or floorcovering are to be brushed and/or beaten, the power head 15 is connected to the housing H. This power head has its own electric motor M and an air intake passage P for dirt that is entrained in an airstream produced by the impeller (not shown) which is driven by the motor M. The power head 15 is detachably connectable with the housing H by a tubular connector 2, details of which are shown in FIG. 2.

Tubular connector 2 has a circumferential wall which surrounds a central airflow passage and is formed with a cutout. Thus cutout removably receives and is closed by a retaining member 7 which defines with an interval wall portion 2*a* a gap 6 that is located laterally of the central airflow passage and separated from the source by the wall portion 2*a*. A transverse reinforcing wall portion 2*b* may be provided, it being understood that this will have a hole forming part of the central airflow passage (the hole is not visible in FIG. 2).

The end 1 of connector 2 is insertable into an appropriate opening of housing H (not shown) where it communicates with a passage leading to receptacle R. Mounted in the central airflow passage of connector 2 is a (preferably plate-shaped) carrier 3 which carries electrical conductors 5 and a set of electrical terminals 4 to which the conductors 5 are connected. The terminals 4 project towards the open end 1 and, when the same is inserted into the opening of the housing H, they engage cooperating terminals of the socket which constitutes the source S in housing H, thereby making an electrical connection at the same time as the airflow connection is made. Terminals 4 and conductors 5 are mounted on the carrier 3 before the same is installed in connector 2, so as to make a sub-assembly.

When this sub-assembly is completed the carrier 3 is inserted through the open end 1, with its end 10 leading. The insertion continues until abutments 8 on the carrier 3 engage one or more shoulders 9 on the circumferential wall of connector 2. Now, the inner free ends of the conductors 5 are engaged through the cutout in the circumferential wall (at this time the member 7 is not yet in place so that the cutout is open) and are inserted into the middle of the associated one of the two hollow bearing trunnions 14*a* which are surrounded by the bearing portions 14. The member 7 is inserted into the cutout to define with wall portion 2*a* the gap 5 in which the conductors 5 extend. Portion 13 of member 7 becomes located behind the part 11 of carrier 3 and a hook-shaped detent portion 12 of member 7 snaps beneath the part 11, pressing it (portion 12 is preferably somewhat resilient) against the portion 13 and holding carrier 3 in place.

The member 7 extends to the pivot axis defined by the trunnions 14*a* and covers the conductors 5 in gap 6 to prevent accidental contact with them. The inner ends of conductors 5 are then connected to the motor M to which they remain permanently connected.

It is evident that the invention enables the rapid assembly of the connector 2, by merely inserting the sub-assembly composed of elements 3, 4 and 5 into the connector 2 and thereafter installing the member 7. The carrier 3 is held in position in a simple manner without any need for such separate connecting elements as screws or the like. Furthermore, the invention now makes it possible to establish simultaneously an airflow connection and an electrical connection between the power head 15 and the housing H by merely inserting the connector 2 into the appropriate opening of the housing H. No skill or dexterity is required, the connection can be made and unmade extremely rapidly and the user is not required to handle any dusty parts of the device.

While the invention has been illustrated and described as embodied in a connector for connecting a power head to a vacuum cleaner, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a vacuum cleaner of the type having a housing provided with a dust receptacle and a source of electric energy and a separate vacuuming head detachably connectable to the housing and provided with a casing having an airflow passage and an electric motor, a combination comprising a tubular connector on said casing and detachably engageable with said housing, said tubular connector having a first end adapted for connection with the vacuum cleaner housing, and a second end communicating with the airflow passage of the casing, said connector further comprising a gap located laterally of and separated from said inlet passage; and means in said connector for communicating said airflow passage with said receptacle and said electric motor with said source in automatic response to engagement of said connector with said vacuum cleaner housing, said means comprising a carrier formed as a plate member and extending in said connector from said first end towards said second end, electrical conductors on said carrier and connected with electrical terminals also on said carrier and projecting towards the exterior of said first end, and retaining means for retaining said carrier in said connector, said retaining means comprising a springy detent in said gap and an engaging portion on said carrier and engageable with said detent with a snap action.

2. A combination as defined in claim 1, said connector having an internal passage communicating said first and second ends and formed with a shoulder inwardly of said first end and wherein said carrier has an abutment adjacent one of its ends which engages said shoulder when the carrier is inserted into said internal passage from said first end in direction towards said second end.

3. A combination as defined in claim 2, wherein said springy detent comprises two parts which are spaced from one another lengthwise of said internal passage and together define a space, said engaging portion being provided adjacent an end of said carrier which is distal from said one end and being receivable with a snap action in said space.

4. A combination as defined in claim 2, said connector having a circumferential wall formed in the region of said second end with a cutout which communicates with said internal passage laterally of said inlet passage; and wherein said retaining means comprises an element detachably mounted in said cutout to close the same and in part bound said gap, said detent being provided on said element.

5. A combination as defined in claim 2, said connector comprising bearing portions adapted to mount it in said casing for pivotal displacement about an axis which extends normal to said internal passage, and wherein said carrier has an end which is distal from said one end and located proximal to said axis.

6. In a vacuum cleaner of the type having a housing provided with a dust receptacle and a source of electric energy and a separate vacuuming head detachably connectable to the housing and provided with a casing having an airflow passage and an electric motor, a combination comprising a tubular connector on said casing and detachably engageable with said housing, said tubular connector having a first end adapted for connection with the vacuum cleaner housing, and a second end communicating with the airflow passage of the casing; and means in said connector for communicating said airflow passage with said receptacle and said electric motor with said source in automatic response to engagement of said connector with said vacuum cleaner housing, said means comprising a carrier formed as a plate member and extending in said connector from said first end towards said second end, electrical conductors on said carrier and connected with electrical terminals also on said carrier and projecting towards the exterior of said first end, and retaining means for retaining said carrier in said connector, said retaining means including a springy detent and an engaging portion on said carrier and engageable with said detent with a snap action.

* * * * *